US007533483B1

(12) United States Patent
Alzamora et al.

(10) Patent No.: US 7,533,483 B1
(45) Date of Patent: May 19, 2009

(54) COMPOSITE MAGAZINE FOR CHAMBERING AMMUNITION IN A FIREARM

(75) Inventors: Ronny Alzamora, Belleville, NJ (US); John Heinsohn, Budd Lake, NJ (US); Adam Foltz, Budd Lake, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 590 days.

(21) Appl. No.: 11/160,376

(22) Filed: Jun. 21, 2005

(51) Int. Cl.
*F41A 9/65* (2006.01)

(52) U.S. Cl. ..... 42/50; 89/197

(58) Field of Classification Search ..... 42/50, 42/49.01, 49.1; 89/195, 197
See application file for complete search history.

(56) References Cited

U.S. PATENT DOCUMENTS

| | | | | | |
|---|---|---|---|---|---|
| 2,895,248 | A * | 7/1959 | Sawin | 42/50 |
| 3,345,770 | A * | 10/1967 | Scanlon, Jr. | 42/18 |
| 3,443,334 | A * | 5/1969 | Ardolino | 42/50 |
| 3,732,643 | A * | 5/1973 | Wells | 42/50 |
| 4,079,535 | A * | 3/1978 | Elbe et al. | 42/49.02 |
| 4,139,959 | A * | 2/1979 | Howard et al. | 42/50 |
| 4,413,437 | A * | 11/1983 | Anderson | 42/50 |
| 4,472,900 | A * | 9/1984 | Howard | 42/50 |
| 4,502,237 | A * | 3/1985 | Krogh | 42/50 |
| 4,514,922 | A * | 5/1985 | Farrar et al. | 42/50 |
| 4,580,364 | A * | 4/1986 | Vyprachticky | 42/50 |
| 4,831,761 | A * | 5/1989 | Kulakow | 42/50 |
| 4,888,900 | A * | 12/1989 | Howard | 42/50 |
| 5,081,778 | A * | 1/1992 | Switzer | 42/50 |
| 5,113,605 | A * | 5/1992 | Kim | 42/50 |
| 5,279,059 | A * | 1/1994 | Howard | 42/90 |
| 5,329,718 | A * | 7/1994 | Howard | 42/50 |
| 5,345,660 | A * | 9/1994 | Howard | 42/49.1 |
| 5,357,703 | A * | 10/1994 | Chesnut et al. | 42/50 |
| 5,615,506 | A * | 4/1997 | Jackson et al. | 42/50 |
| 5,638,626 | A * | 6/1997 | Westrom | 42/50 |
| 2005/0188579 | A1 * | 9/2005 | Gates | 42/50 |

* cited by examiner

*Primary Examiner*—Bret Hayes
(74) *Attorney, Agent, or Firm*—John F. Moran

(57) ABSTRACT

An improved magazine for use in existing firearms comprises a housing, a follower, a spring, a spring hold and a cap. The housing comprises protruded surfaces for structural strength and a projection that acts as a stop member to define the maximum insertion of the magazine into the firearm magazine well. The follower comprises two follower legs and a spring retainer, and travels up and down the housing. The perimeters of the follower and follower legs mirror the internal profile of the magazine housing for a well-defined travel path within the magazine housing. The spring hold comprises a spring retainer and a round protrusion that locks it into the cap via a circular cut. The cap comprises flanges that slide into the slots against the end stop at the bottom of the housing.

7 Claims, 9 Drawing Sheets

COMPOSITE MAGAZINE FOR CHAMBERING AMMUNITION IN A FIREARM

FEDERAL INTEREST STATEMENT

The inventions described herein may be manufactured, used and licensed by or for the U.S. Government for U.S. Government purposes.

FIELD OF INVENTION

The present invention generally relates to a firearm. More specifically, the present invention relates to a magazine for chambering ammunition in the firearm. In particular, the present invention pertains to a magazine constructed by an injection molding process of a composite material, and a follower formed in the magazine to create an even force distribution on the ammunition within the magazine chamber to minimize jamming.

BACKGROUND OF THE INVENTION

Automatic and semi-automatic firearms typically comprise a magazine in which one or more rounds of ammunition are placed. The magazine comprises a magazine follower that pushes the topmost round into position for chambering in the automatic or semi-automatic firearm. For example, a M16 Rifle or M4 Carbine comprises a 30 round magazine. The first round placed in the magazine, presses against the magazine follower. Additional rounds placed in the magazine compress the magazine follower toward the bottom of the magazine. The magazine comprises, for example, a spring that applies force to the rounds in the magazine, pushing the rounds up toward the chamber of the automatic or semi-automatic firearm.

A conventional 30 round magazine comprises a magazine follower that has a tendency to jam and not properly feed the round into the automatic or semi-automatic firearm. As rounds are loaded into the magazine, an off-center pressure on the magazine follower can cause the magazine follower to bind, interrupting and slowing the process of loading rounds in the magazine. Thus, there is need for an improved magazine follower that minimizes jamming or binding during loading of the magazine or firing of the automatic or semi-automatic firearm. The need for such a magazine has heretofore remained unsatisfied.

SUMMARY OF THE INVENTION

The present invention satisfies this need, and presents a magazine for use in existing firearms. While the present magazine will be described herein in relation to a 30 round magazine, for illustration purpose only, it should be clear that the present magazine could also accommodate a different number of rounds.

The present magazine generally comprises a housing, a follower, an elastic element such as a spring, a spring hold, and a cap. The magazine is assembled by placing the follower in a magazine to rest against the cartridge loading end of the magazine housing. The spring is inserted into the housing to have a first end to rest on a side of the follower. The spring hold is placed inside the housing against a second end of the spring. The cap is placed behind the spring hold to lock it in place inside the housing. When the magazine is assembled, the spring pushes against the follower and the spring hold.

The firearm operator places one or more rounds of ammunition against the follower in the magazine. The spring pushes against the follower and the rounds of ammunition, presenting the top-most round of ammunition for loading into the firearm. During loading and dispensing rounds of ammunition in the magazine, the follower slides up and down inside the magazine. As the ammunition pushes the follower downward, with respect to the bottom of the magazine, it causes the follower to slide downward. The force of the spring on the follower causes the follower to slide upward. The magazine is preferably made by injection molding a composite material, such as glass reinforced nylon or other similar materials.

The magazine profile creates a uniform flow for minimizing the jamming of the follower. The follower comprises follower legs and a spring retainer that retains the spring in position. The external profile of the external is such that it travels smoothly upward and downward within the magazine, while loading and dispensing cartridges, tracking the interior of the magazine as the follower is pushed upward by the spring. By mirroring the interior profile of the magazine, the follower has a motion that follows a well-defined path within the magazine.

The magazine and follower reduce jamming and high friction points throughout the cycle of loading and dispensing rounds of ammunition. In conventional magazine followers, high friction points cause stress or wear on the magazine follower, further causing the magazine follower to jam or otherwise malfunction.

One object of the present invention is to reduce the stoppage, jamming, and malfunction, in order to improve the long-term durability and reliability of magazines, such as the 30 round magazine.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

Figure 2:
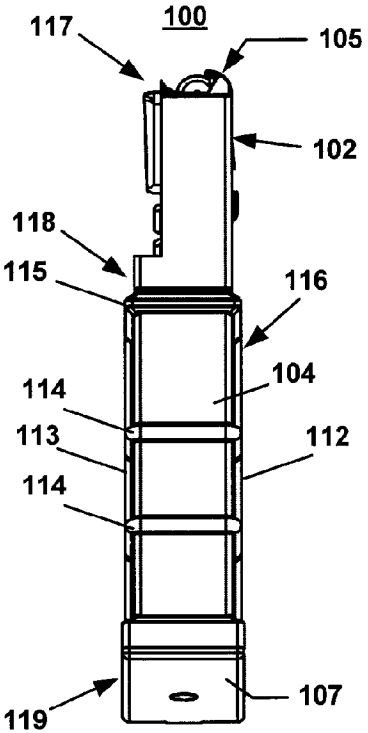
FIG. 2 is a side view of the magazine of FIG. 1.
Figure 1:
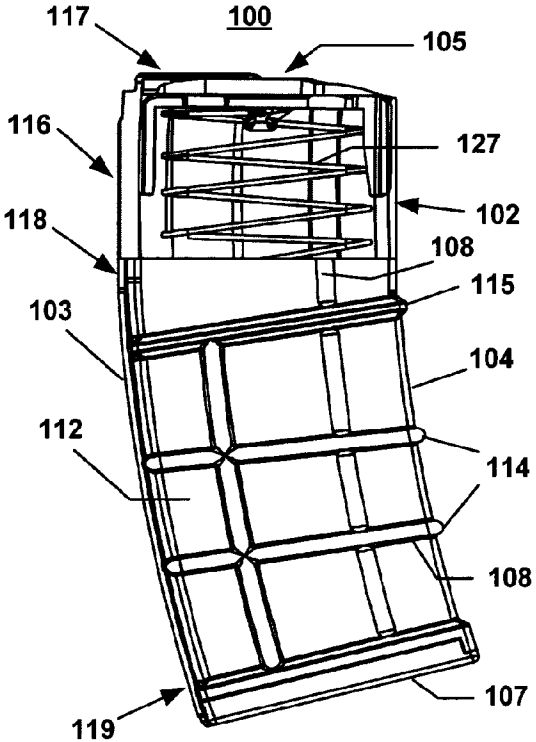
FIG. 1 is a front view of a magazine of the present invention.
Figure 3:
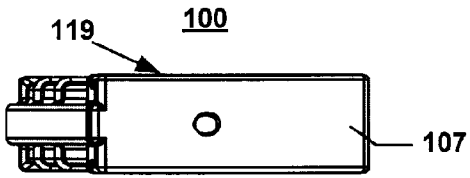
FIG. 3 is a bottom view of the magazine of FIGS. 1 and 2.

FIGS. 1, 2, and 3 illustrate an exemplary magazine 100 that generally comprises a housing 102, a follower 105, an elastic element such as a spring 127, a spring hold 106 (illustrated in FIGS. 9, and 11) that is disposed inside the housing 102, and a cap 107. FIG. 1 illustrates the disposition of the spring 127 inside the housing 102. The spring 127 is disposed between the follower 105 and the spring hold 106 adjacent to the cap 107.

The housing 102 comprises a top end 117, a bottom end 118, and a housing body 119. The housing 102 functions as an external shell of the magazine 100 to accommodate the various components of the magazine 100. In the exemplary magazine 100 shown in FIG. 1, and in particular the 30 round magazine, the housing 102 comprises a curvilinear profile with generally curved surfaces and a substantially rectangular cross section.

The housing 102 comprises a front wall 112 and a rear wall 113 that are substantially planar and parallel, and two sidewalls 103 and 104 that are curvilinear with a continuous radius of curvature. This curvature creates the side profile 116 on the side of the housing 102. The top end 117 of the housing 102 allows for ammunition or cartridge loading and dispensing, and the bottom end 119 of the housing 102 allows for the quick assembly and disassembly of the cartridge 100.

Prior to loading the ammunition, the follower 105 rests against the top end 117 of the housing 102. The spring hold 106 is disposed on the other side of the housing 102 in a mating relationship with the cap 107 that is secured to the bottom end 119 of the housing 102. The spring 127 is in snug contact with both the spring hold 106 and the follower 105. The spring 127 applies a force to the follower 105, pushing the follower 105 to the top end 117 of the housing 102. The spring 127 also applies a force to the spring hold 106, pushing the spring hold 106 against the cap 107 that is secured to the bottom of the magazine housing 102.

To load the magazine 100 with ammunition, a firearm operator inserts one or more rounds of ammunition into a dedicated feed opening 414 (FIG. 4) in the top end 117 of the magazine 100, pushing the follower 105 toward the bottom end 119 of the magazine 100. The exemplary magazine 100 can accommodate, for example, 30 rounds of ammunition. While the magazine follower 105 is described for illustration purpose only in relation to a 30 round magazine, it should be clear that the magazine follower 105 is similarly applicable to other magazines.

The magazine housing 102 has a predefined internal shape. Side recesses 108 on the housing walls guide the follower 105 in its upward and downward translation along the internal profile of the housing 102. In one embodiment, the housing 102 has a generally curved shape, and the recesses 108 on the side walls of the housing have a matching curvature to firmly guide the follower 105 to travel up and down the housing 102. The design of the follower 105 to achieve snug movement along the housing 102, in order to minimize jamming will be explained in more detail in connection with FIGS. 6 and 7.

The housing 100 comprises multiple ridges 114 that distributed across the body 118 of the housing 102. The ridges 114 enhance the structural strength of the housing 102. In a specific embodiment, the ridges 114 or protrusions are substantially orthogonal to a magazine axis, and generally encircle the perimeter of the housing 102.

The housing 102 further comprises a stop member 115 disposed along the housing body 118, for defining the maximum insertion of the magazine 100 into a firearm magazine well of the host weapon system. When the magazine 100 is in position inside the firearm magazine well, a rectangularly shaped, recessed magazine release window 411 locks the magazine 100 to the host weapon system. The magazine release window 411 will be further described in more detail in connection with FIG. 4.

The angular disposition of the stop member 115 and the side profile 116 of the housing 102, guide the insertion of the magazine 100 inside the firearm magazine well.

In the present embodiment, the housing 102, follower 105, spring hold 106, and cap 107 are preferably made by an injection molding process, using at least one type of composite material that is optimized for the following properties: chemical resistance, heat deflection, cost, tensile strength, stiffness, and low temperature impact strength. The proper selection of these properties, ensures that the magazine 100 is at least as efficient as conventional magazine designs.

FIG. 2, illustrates the front and back walls 112 and 113 of the housing 102 as being substantially planar, the ridges 114 are substantially orthogonal to the magazine axis, and generally encircle the perimeter of the housing 102. The ridges 114 further enhance the structural strength of the magazine 100.

The angle that the stop member 115 creates and the side profile 116 of the housing 102, orient the magazine correctly inside the firearm magazine well. The projection 115 also acts as a stop member for defining the maximum insertion of the magazine into the firearm magazine well.

FIG. 3 illustrates the bottom end 119 of the magazine 100 shown capped with the cap 107. The cap 107 is secured snugly to the bottom end 119 of the housing 102, locking the follower 105, the spring 127, and the spring holder in position inside the housing 102.

Figure 4:
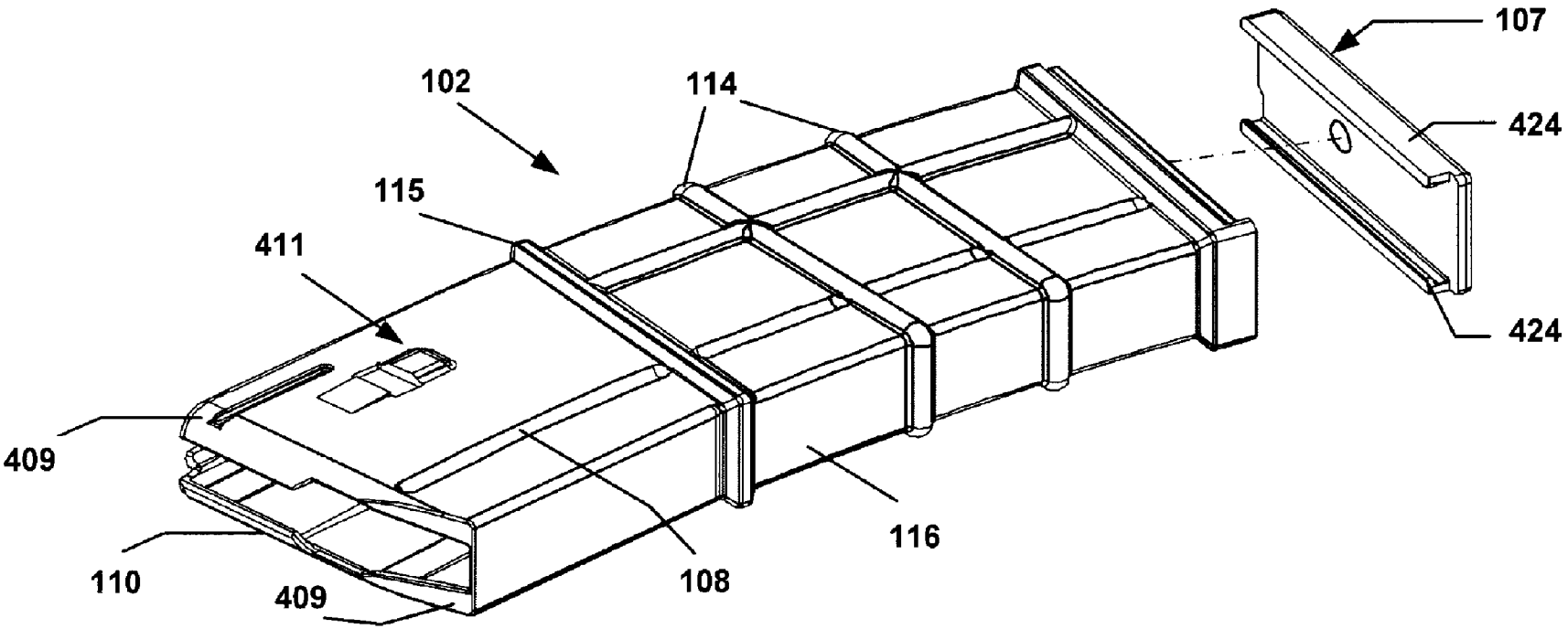
FIG. 4 is an isometric view of the magazine of FIGS. 1 and 2, illustrating a housing and a cap with flanges.

FIG. 4 is an exploded, assembly view of the housing 102 and the cap 107. The top end 117 of the housing 102 comprises a feed opening 414 defined by two feed lips 409 that are curved inwardly to secure the ammunition in position within the housing 102. As described earlier, the recessed magazine release window 411 locks the magazine to the host weapon. The magazine release window 411 extends partly through the wall thickness in order to prevent foreign substances from endangering the magazine functionality.

Figure 5:
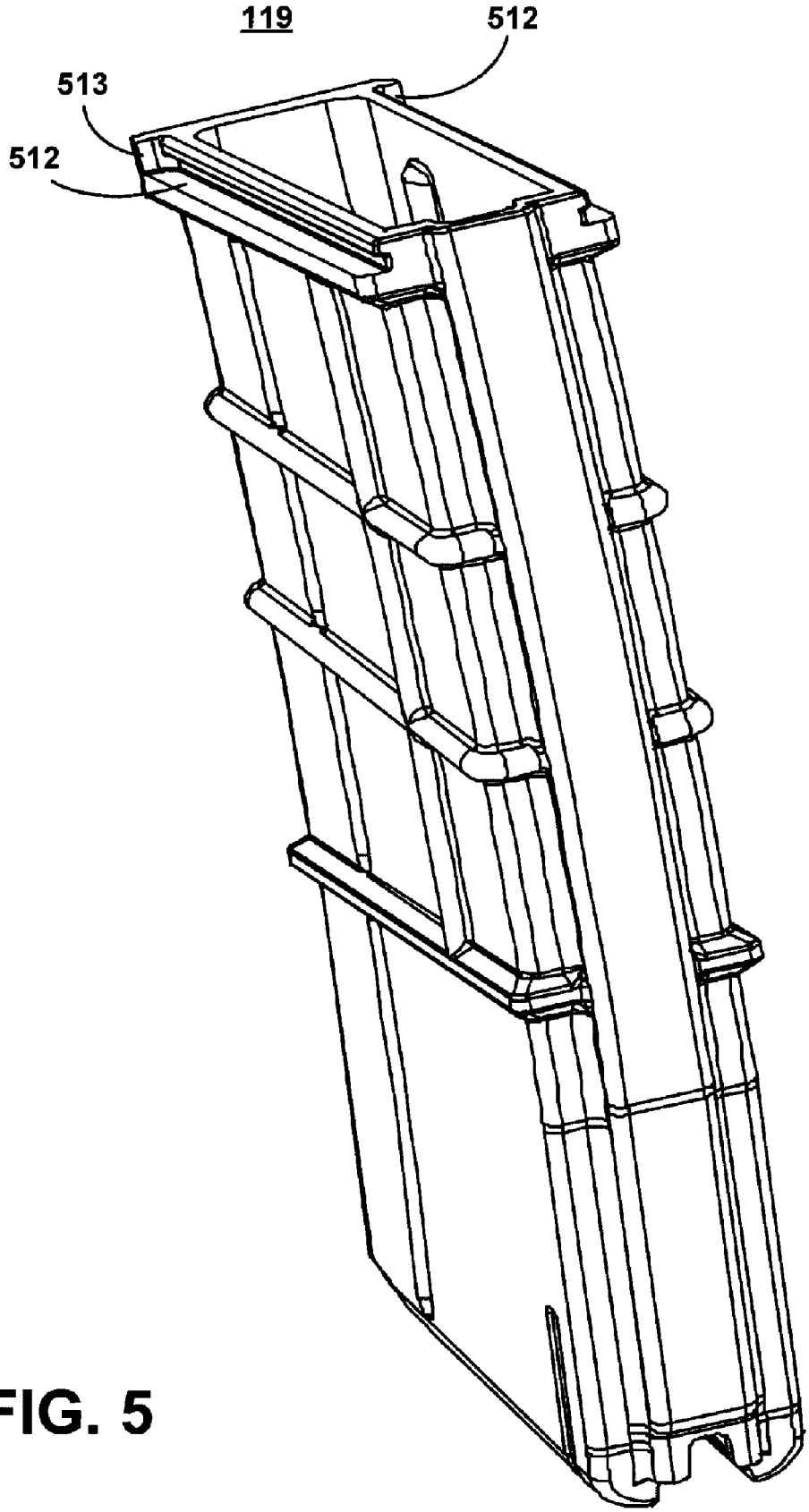
FIG. 5 is an isometric view of the bottom end of the magazine of FIG. 4, showing slots that mate with flanges of the cap.

FIG. 5 illustrates the bottom end 119 of the magazine 100 as including two generally parallel slots 512 and an end stop 513. The cap 107 includes two parallel edges 424 (FIGS. 4 and 12) that cooperate with, and slide along the slots 512 to secure the cap 107 to the housing 102. The end stop 513 is disposed at one end of the slots 512 to stop further travel of the cap 107 over the slots 512 and to retain the cap 107 in position.

Figure 6:
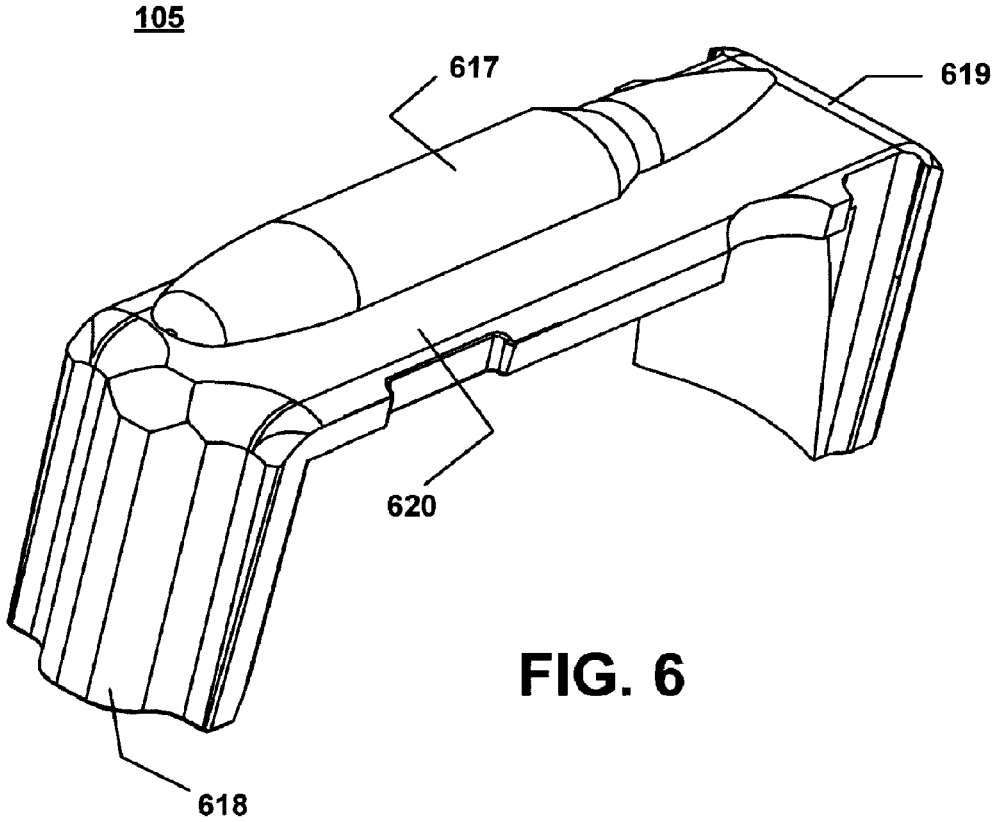
FIG. 6 is a top isometric view of a magazine follower, showing the follower, the follower legs, and an ammunition-shaped protuberance.
Figure 7:
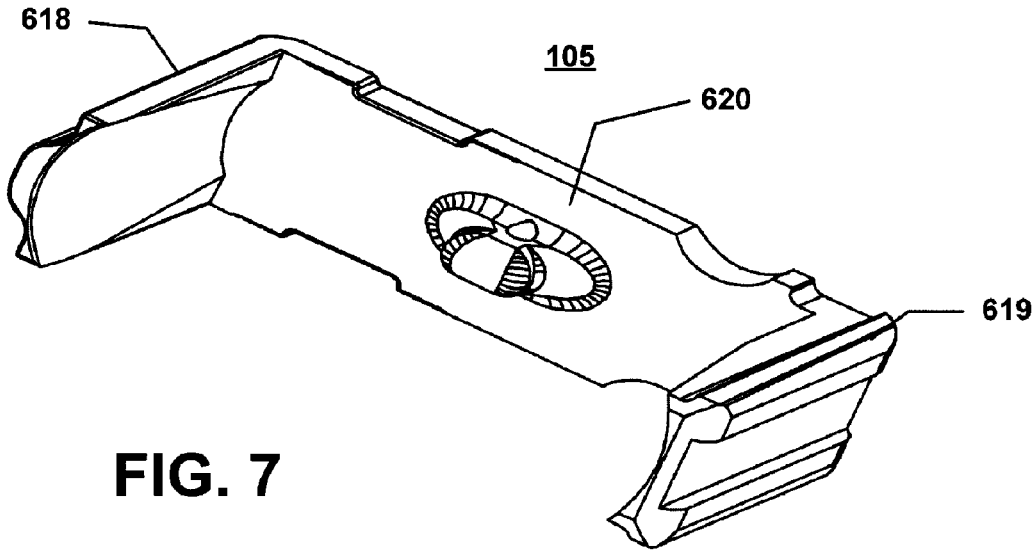
FIG. 7 is a bottom isometric view of the magazine follower of FIG. 6.

FIGS. 6 and 7 illustrate the magazine follower 105 as comprising two follower legs 618 and 619, an ammunition-shaped protuberance 617, and a perimeter that is generally smooth and devoid of sharp corners and edges, which corners and edges tend to cause stoppage, jamming, or malfunction of the follower 105 in the magazine 100.

The follower 105 has a predefined external shape that corresponds to the internal profile of the housing 102, so as to allow the follower 105 to snuggly travel inside the housing 102, along the internal profile of the housing 102. The follower perimeter further comprises contours that closely mirror the internal profile of the magazine housing 102, such as the side recesses 108 shown in FIG. 1, constraining the motion of the follower 105 to a well-defined path within the magazine housing 102. It also results in smooth and tightly controlled follower travel up and down the magazine housing 102.

The follower legs 618 and 619 extend sidewise from a follower body 620, so that when the follower 105 is assembled inside the housing 102, the legs 618, 619 maintain a continuous sliding contact with the interior surface of the housing 102. Similarly to the follower 105, the follower legs 618 and 619 comprise contours that closely mirror the internal profile of the housing 102, further reinforcing a smooth and tightly controlled follower travel up and down the housing 102. In a specific embodiment, the contours of the follower legs 618 and 619 assume an undulating shape for a tightly controlled travel.

The follower 105 further comprises an ammunition-shaped protuberance 617 formed in the follower body 620, with a predefined orientation. This protuberance 617 ensures that the magazine is inserted correctly inside the firearm magazine well, as well as the correct orientation of cartridges during ammunition loading.

The follower 105 and follower legs 618 and 619 are preferably made by means of an injection molding process, using the composite material described earlier.

Figure 8:
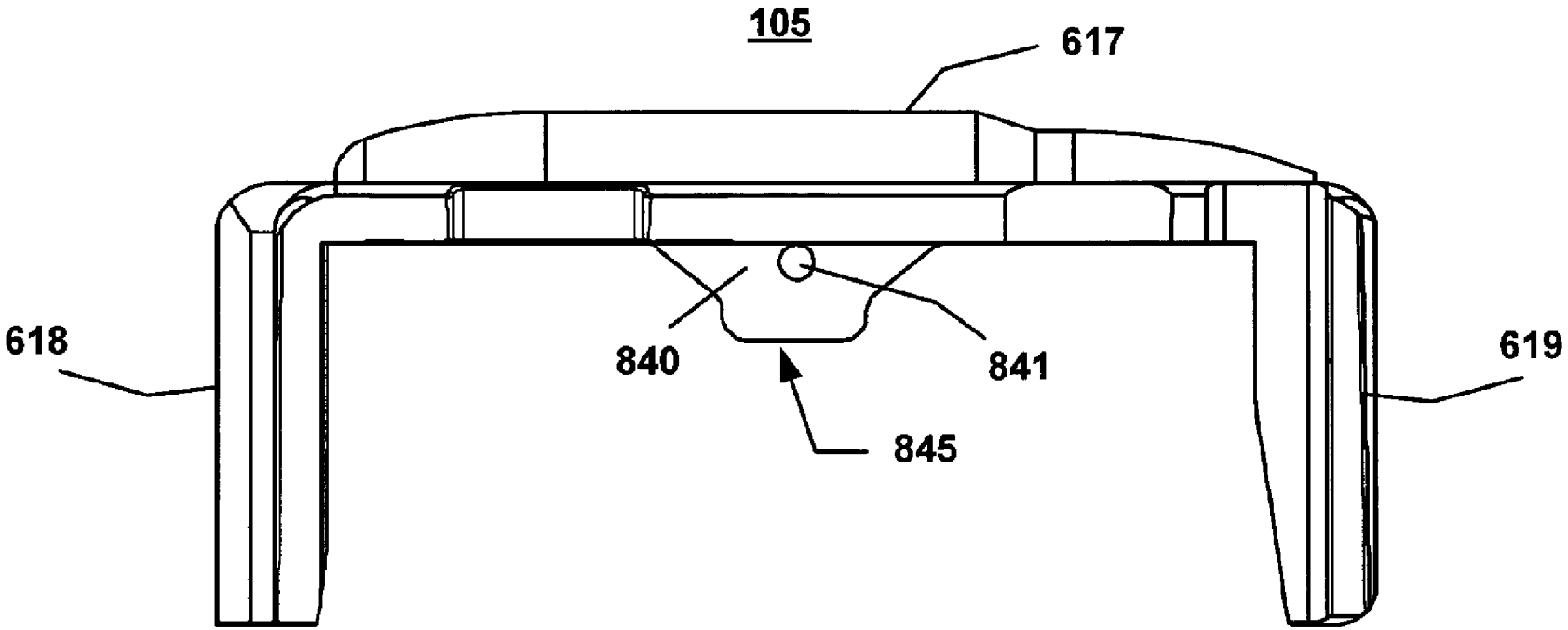
FIG. 8 is a side view of another embodiment of a follower for use with the magazine of FIG. 1, comprising a follower opening and a central stud.

FIGS. 6, 7, and 8 represent embodiment of the follower 105 with a spring retainer 845 formed on its underside to retain the spring 127. The spring retainer 845 comprises a central stud 840 and a follower opening 841. The central stud 840 is formed on the underside of the follower 105, with the follower opening 841 formed in the central stud 840. The follower opening 841 receives the spring's angled follower end 1335 FIG. 11B) to secure the spring 127 to the follower 105. Further details on the spring 127 will be explained in connection with FIG. 13 FIG. 11.

A first turn 1331 of the spring 127 is shaped such that a portion of the first turn 1331 lies against the follower 105, positioning the first turn 1331 to the spring retainer 845. The first turn 1331 of the spring 127, thus positioned against the follower 105, provides an evenly distributed, stable force from the spring 127 to the rounds of ammunition through the follower 105.

Figure 9A:
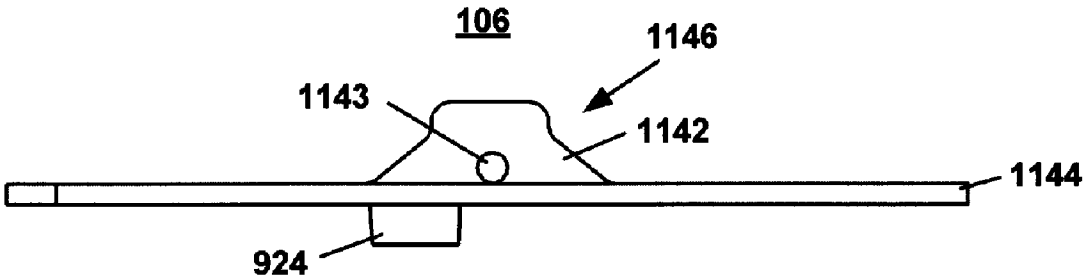
FIG. 9 comprises FIGS. 9A, 9B, and 9C, and illustrates another embodiment of the spring hold with a spring hold opening and a spring hold stud.
Figure 9B:
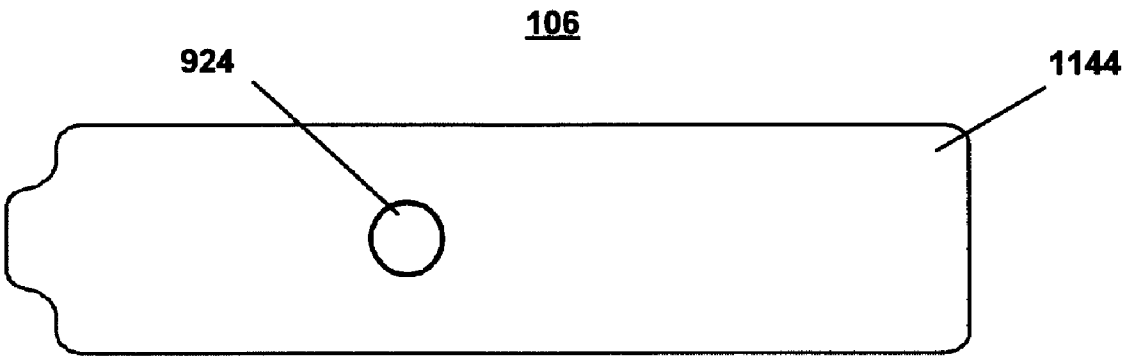
Figure 9C:
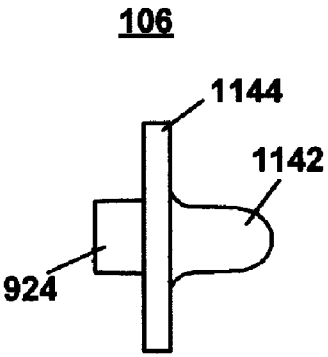

FIG. 9(FIGS. 9A, 9B and 9C) represents another embodiment of the spring hold 106 that includes a spring retainer 1146, a spring hold stud 1142, and a spring hold opening 1143. In a variation of the embodiment described in FIG. 10 on the spring retainer in the spring hold, FIG. 11 shows the spring hold 106 as comprising a plate 1144, a round protrusion 924, and a spring retainer 1146. The spring retainer 1146 comprises a spring hold stud 1142 on one side of the spring hold 106, with a spring hold opening 1143 placed in the spring hold stud 1142. The spring hold opening 1143 receives the spring's angled spring hold end 1336 in FIG. 11B to secure the spring 127 to the spring hold 106.

A first turn 1330 of the spring 127 is shaped such that a portion of the first turn 1330 lies against the spring hold 106, positioning the first turn 1330 to the spring hold 106. The first turn 1330 thus positioned against the spring hold 106 provides an evenly distributed, stable force from the spring 127 to the spring hold 106.

Figure 10:
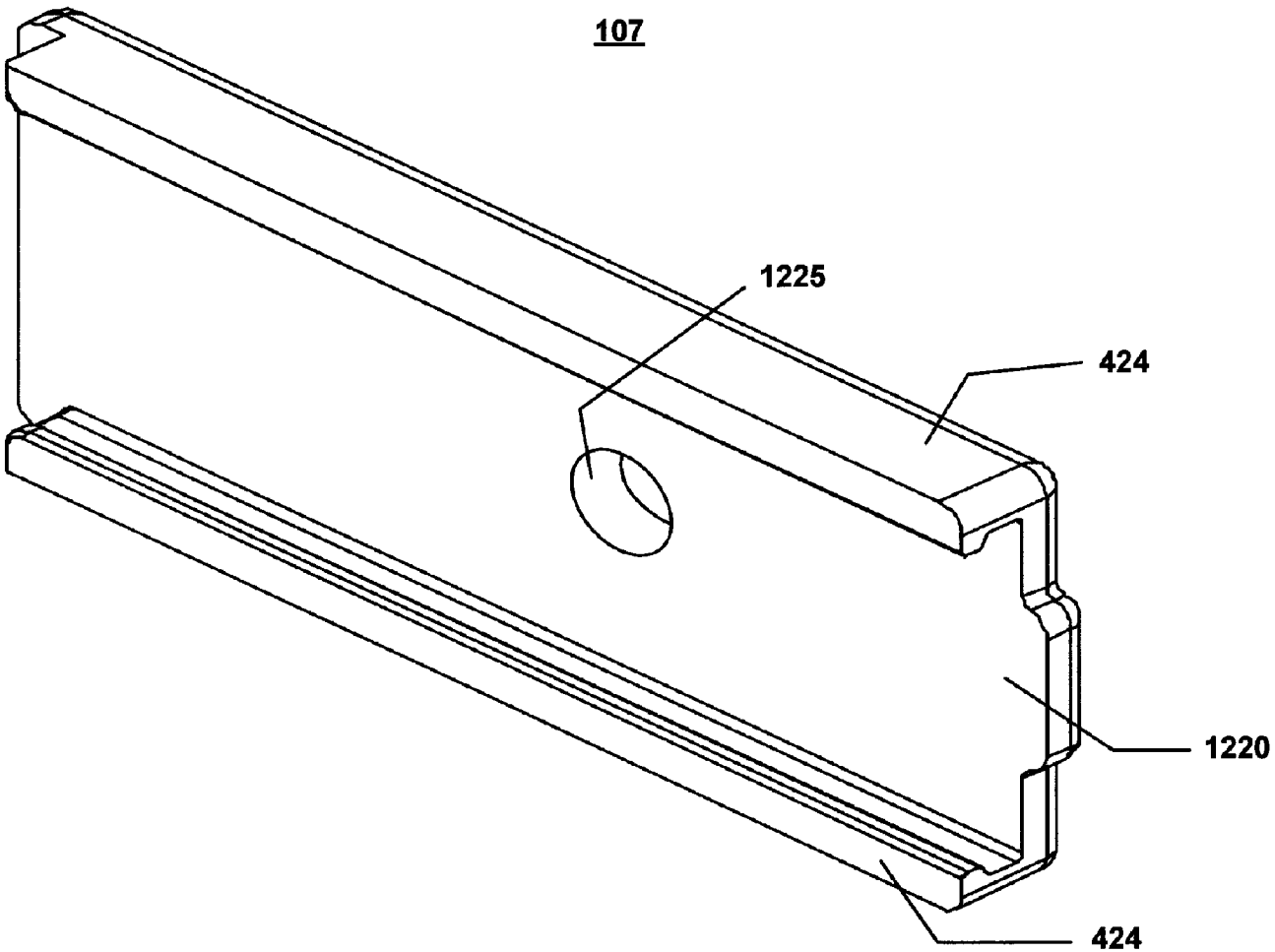
FIG. 10 is an enlarged, isometric view of the magazine cap of FIG. 4, showing a circular opening and side flanges that slide over the slots on the bottom surface of the housing.
Figures 11A, 11B:
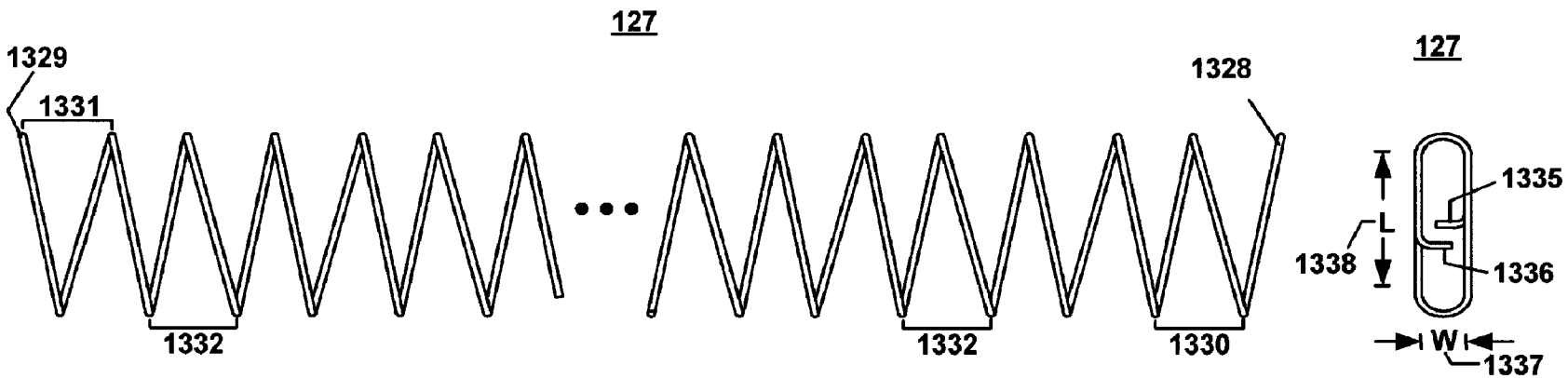
FIG. 11 comprises FIGS. 11A, 11B, 11C, and 11D, and illustrates various views of the spring in contact with the follower and the spring hold.

FIG. 10 is an isometric view of the magazine cap 107, illustrating an inward surface 1220 with a circular cut 1225 and side flanges 424 that slide over the slots on the bottom surface of the housing 102 as explained earlier. The cap 107 comprises a substantially rectangular plate with flanges 424 that attach to two opposing edges of the cap on the inward surface 1220. The flanges 424 are shaped to mirror the slots 512 on the base end of the housing 102 as shown in FIG. 5. The cap 107 is in snug sliding contact over the slots 512 against the end stop 513. The outward facing side of the cap 107 is on the cap surface opposite from the flanges 424.

The cap circular cut 1225 cooperates or mates with the round protrusion 924 on the spring hold 106 of FIG. 9, to lock the spring hold 106 in the housing 102. During the magazine assembly process, the follower 105 is placed into the housing 102, followed by the spring 127 secured to the spring retainer on the underside of the follower 105, then the spring hold 106 having its own spring retainer against the spring 127.

The cap 107 slides over the slots 512 at the base of the housing 102, depressing the spring hold 106 into the magazine housing 102, and passing over the round protrusion 924. The end stop 513 limits the cap travel over the slots 512, and the round protrusion 924 on the spring hold slips into the circular cut 1225 and stays captured, under the push from the spring force on the spring hold. The cap 107 functions to lock the follower 105, the spring 127 and the spring hold 106 in the housing 102 of magazine 100. Hence the magazine's components are accurately assembled into position for accuracy, consistency and proper functioning.

For disassembly of the magazine 100, the assembly process can be reversed. In a preferred embodiment of the circular cut 1225 on the cap 107, the circular cut 1225 is a through cut to facilitate easier access to the round protrusion 924 on the spring hold for the disassembly process.

The cap 107 is preferably made by means of an injection molding process using the composite material described earlier.

Figure 11D:
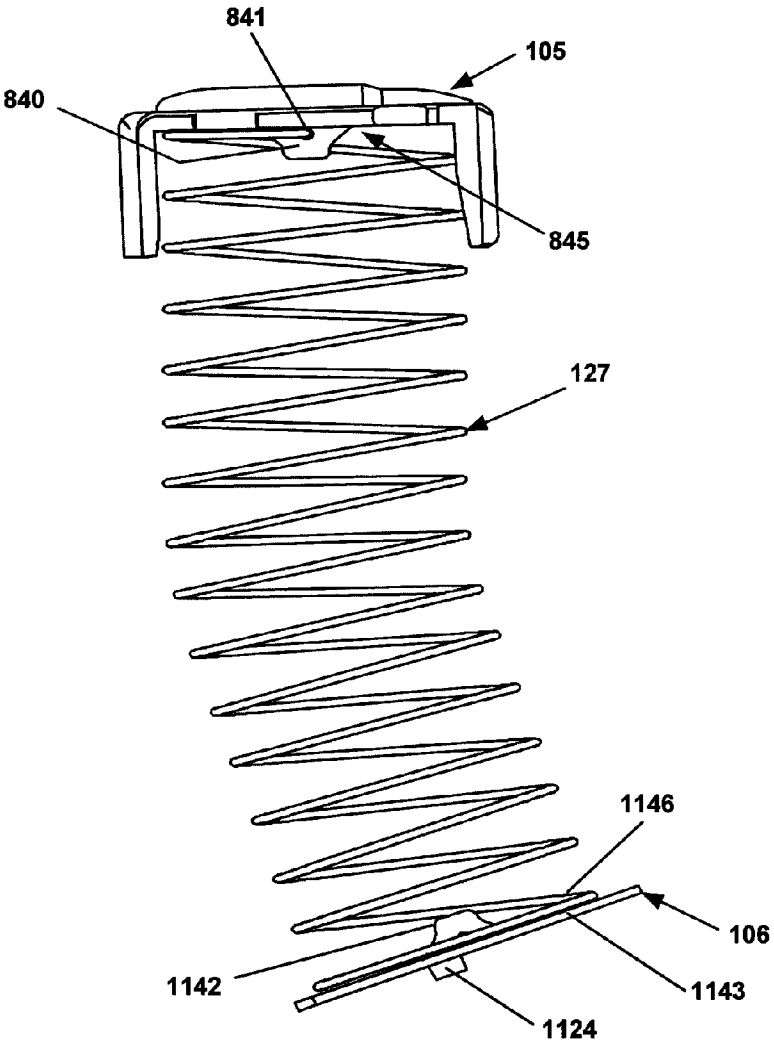
Figure 11C:
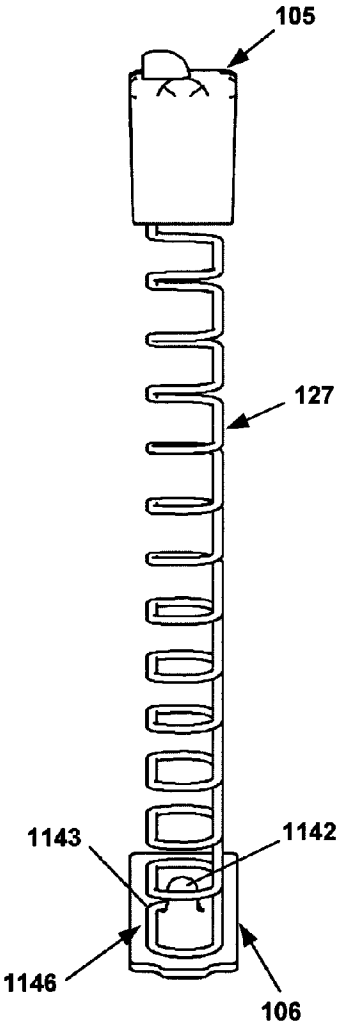

FIG. 11 (FIGS. 11A, 11B, 11C and 11D) illustrates the spring 127 in contact with the follower 105 and the spring hold 106 in the magazine housing 102. Spring 127 comprises a stainless steel wire that is wound into, for example, 15 turns such as, for example, turn 1332. While FIG. 11A illustrates a 15-turn spring in the exemplary magazine 100, any number of turns may be used in the magazine to provide the force necessary to propel the rounds of ammunition up the magazine into a firearm chamber. A typical spring 127 will comprise a range of 15 to 16 turns.

As further illustrated by FIGS. 11A and 11B, the spring 127 has a substantially elongated shape, such that the length, L, 1338 is longer than the width 1337 of the spring 127. Further, the spring length, L, 1338 127 is preferably, approximately 80% of the length of the spring hold 106. The width, W, 1337 of the spring 127 is approximately 80% of the width of the spring hold 106. The elongated shape of the spring 127 provides evenly distributed force across the follower 105 as the spring 127 propels the follower 105 up the magazine 100.

The elongated shape of the spring 127 defines a predetermined ratio of the length, L, 1338 of the spring 127 to the width, W, 1337 of the spring 127. However, any spring shape may be used that fits within magazine 100 and that provides adequate force to propel the magazine follower against the rounds of ammunition loaded in magazine 100.

Spring 127 comprises a follower end 1329 and a spring hold end 1328. The follower end 1329 fits into the spring retainer 840 of the follower 105 (FIG. 7), securing the spring 127 to the follower 105. A first turn 1331 of the spring 127 comprises a shape such that a portion of the first turn 1331 lies against the follower 105, positioning the first turn 1331 to the spring retainer 840. The first turn 1331 of the spring 127 thus positioned against the follower 105, provides an evenly distributed, stable force from the spring 127 to the rounds of ammunition through the follower 105.

The spring hold end 1328 fits into the spring retainer 1143 of the spring hold 106 (FIG. 9), securing the spring 127 to the spring hold 106. A first turn 1330 of the spring 127 is shaped such that a portion of the first turn 1330 lies against the spring hold 106, positioning the first turn 1330 to the spring retainer 1146. The first turn 1330 of the spring 127 thus positioned against the spring hold 106 provides an evenly distributed, stable force from the spring 127 to the spring hold 106.

FIG. 11B further illustrates the substantially rectangular configuration of the spring 127 in the exemplary magazine 100. An embodiment of spring 127 comprises a follower end 1335 and a spring hold end 1336. For the purpose of illustration, the follower end 1335 and the spring hold end 1336 of the spring 127 are shown as being spaced apart. In one embodiment of spring 127, the follower end 1335 and the spring hold end 1336 of the spring 127 essentially overlap. In general, the spring 127 can work in either orientation in the magazine 102.

FIGS. 11C and 11D represent orthogonal views of the spring 127 in contact with the follower 105 and the spring hold 106. The spring 127 secures to, and presses against the follower 105 by inserting its follower end 1335 into the follower opening 841 in the central stud 840 of the spring retainer 845 on the follower 105. The spring 127 secures to, and presses against the spring hold 106 by inserting its spring hold end 1336 into the spring hold opening 1143 in the spring hold stud 1142 of the spring retainer 1146 on the spring hold 106.

FIG. 11D illustrates that the elongated spring 127 readily adapts to conform to the curved profile 116 of the magazine housing 102. In a general manner of operation, the spring 127 just as easily adapts to a straight magazine or other curvilinear or angle shaped magazines.

It is to be understood that the specific embodiments of the invention that have been described are merely illustrative of certain applications of the principle of the present invention. Numerous modifications may be made to the improved magazine for a magazine used by a firearm described herein without departing from the spirit and scope of the present invention.

What is claimed is:

1. A magazine for use with a firearm to fire rounds of ammunition, comprising:

a housing made by injection molding a first composite material, to a predefined internal shape;

a follower disposed within the housing and made by injection molding a second composite material, to a predetermined external shape that corresponds to the internal shape of the housing, so as to allow the follower to travel inside the housing, alone the internal shape of the housing;

a spring disposed within the housing, and comprising a follower end that presses against the follower;

a hold disposed within the housing, to press against a spring end of the spring;

wherein the hold comprises a protrusion;

a cap secured to the housing, and mating with the hold protrusion to lock the hold in position within the magazine;

wherein the spring includes a spring end, and a plurality of turns that are formed intermediate the follower end and the spring end;

wherein at least a portion of one of the turns of the spring near the follower end of the spring presses against the follower while the follower is traveling inside the housing, in order to allow the spring to apply a uniform force across the follower; and wherein the follower comprises a spring retainer having a ridge that defines an area into which the spring sits against the follower during travel, to provide an evenly distributed, stable force from the spring to the rounds of ammunition through the follower, further comprising a spring hold; and wherein at least a portion of one of the turns of the spring near the spring end of the spring presses against the spring hold, allowing the spring to apply a uniform force across the spring hold.

2. The magazine of claim 1, wherein the spring hold comprises a spring retainer to retain the spring hold end of the spring.

3. The magazine of claim 2, wherein the spring comprises approximately 15 turns.

4. The magazine of claim 2, wherein spring comprises approximately 15 to 16 turns.

5. The magazine of claim 2, wherein the spring has an elongated circumference with a length of approximately 80% the length of the spring hold.

6. The magazine of claim 2, wherein the spring has an elongated circumference with a width of approximately 80% the width of the spring hold.

7. The magazine of claim 2, wherein the spring is made of stainless steel.

* * * * *